United States Patent [19]

Halstead

[11] 4,266,607

[45] May 12, 1981

[54] METHOD FOR PROTECTING A CARBON DIOXIDE PRODUCTION WELL FROM CORROSION

[75] Inventor: Louis N. Halstead, Houston, Tex.

[73] Assignee: Mobil Oil Corporation, New York, N.Y.

[21] Appl. No.: 137,701

[22] Filed: Apr. 7, 1980

[51] Int. Cl.[3] ..... E21B 43/00

[52] U.S. Cl. ..... 166/244 C; 166/310; 166/314

[58] Field of Search ..... 166/244 C, 310, 312, 166/314

[56] References Cited

U.S. PATENT DOCUMENTS

| | | | |
|---|---|---|---|
| 2,089,035 | 8/1937 | Oberlin | 166/310 |
| 2,357,559 | 9/1944 | Smith . | |
| 2,510,771 | 6/1950 | Bond et al. . | |
| 2,654,436 | 10/1953 | Carlisle et al. . | |
| 2,773,551 | 12/1956 | Warden et al. . | |
| 2,795,278 | 6/1957 | Battle . | |
| 2,801,697 | 8/1957 | Rohrback . | |
| 3,076,503 | 2/1963 | Jones | 166/244 C X |
| 3,369,606 | 2/1968 | Troeller | 166/312 X |
| 3,385,358 | 5/1968 | Shell . | |
| 4,031,955 | 6/1977 | Ledet | 166/244 C X |

FOREIGN PATENT DOCUMENTS

| | | | |
|---|---|---|---|
| 495832 | 9/1953 | Canada | 166/312 |
| 426029 | 10/1974 | U.S.S.R. | 166/312 |

*Primary Examiner*—Stephen J. Novosad
*Assistant Examiner*—George A. Suchfield
*Attorney, Agent, or Firm*—Charles A. Huggett; Michael G. Gilman; James F. Powers, Jr.

[57] ABSTRACT

A method for protecting the steel casing and production tubing in a carbon dioxide production well from the corrosive effects of the produced carbon dioxide. The cased well is filled with corrosion inhibitor liquid and fluid communication between the producing formation and the casing is established by perforating or the like. A pump means, e.q. electrically driven, centrifugal pump system and a packer means are lowered on the production tubing to a point adjacent or slightly above the producing formation. The packer means is set to isolate the pump means from the well annulus above the packer means. The corrosion inhibitor liquid below the packer is pumped to the surface through the production tubing and the well is now ready to produce carbon dioxide. The corrosion inhibitor liquid in the well annulus above the packer remains in place and will absorb any carbon dioxide that may leak by or permeate through the packer means thereby alleviating the corrosive effects of such carbon dioxide on both the casing and tubing above the packer means.

6 Claims, 2 Drawing Figures

METHOD FOR PROTECTING A CARBON DIOXIDE PRODUCTION WELL FROM CORROSION

BACKGROUND OF THE INVENTION

The present invention relates to the production of carbon dioxide from a subterranean formation and more particularly relates to a method of completing a carbon dioxide well to alleviate the corrosive effects of produced carbon dioxide on the casing and tubing strings in the well.

It has long been recognized that carbon dioxide may be injected into an oil-bearing formation during a secondary or tertiary enhanced recovery operation to produce additional amounts of oil. One of the most attractive sources for carbon dioxide for this purpose is natural subterranean formations which produce large volumes of almost pure carbon dioxide. Unfortunately, many of the known formations capable of producing carbon dioxide in quantities sufficient for enhanced oil recovery operations are located several hundred miles from the oil fields in which the carbon dioxide is to be used. Accordingly, the carbon dioxide must be gathered from the carbon dioxide producing wells, treated, and then pipelined to several hundred miles to its final destination. Due to the physical properties of carbon dioxide, it normally arrives at the surface from a production well in a two-phase state. As is known, flowing such a two-phase fluid through a pipeline over long distances of varying elevations creates a fluid "hammer" effect which is likely to cause serious damage to the pipeline and related equipment as well as considerable loss of horsepower. Therefore, the carbon dioxide has to be gathered and processed at or near the production wells and delivered to the pipeline as a single phase fluid, either gas, liquid, or supercritical fluid.

One method for producing and gathering carbon dioxide in a single supercritical phase is fully disclosed in copending U.S. patent application Ser. No. 38,034, filed May 10, 1979. This method involves lowering a pump means into a carbon dioxide production well to boost the pressure of the carbon dioxide downhole to value sufficient to insure that the carbon dioxide produced at the surface will have a pressure greater than its critical pressure.

However, in the above-mentioned production method, it has been found that when carbon dioxide rises in the annulus formed between the well casing and the tubing string, it expands due to the reduction in temperature and pressure and water vapor carried by the carbon dioxide condenses onto both the interior surface of the casing string and the exterior surface of the tubing string. This water in conjunction with carbon dioxide in the annulus forms carbonic acid which when in contact with the steel casing and tubing causes extreme corrosive conditions which normally leads to rapid deterioration and failure of the casing and/or tubing strings.

SUMMARY OF THE INVENTION

The present invention provides a method for protecting a carbon dioxide well from the corrosive effects of the produced carbon dioxide and more particularly provides a method of completing a carbon dioxide well so that the corrosive effects of the produced carbon dioxide on the casing and tubing strings are alleviated.

More specifically, a well is drilled into a carbon dioxide producing formation. The wellbore is cased with a first conduit, i.e. casing string, by techniques well known in the art. The cased well is then filled with a corrosion inhibitor liquid and fluid communication is established between the carbon dioxide producing formation and the interior of the first conduit, e.g. by perforating the first conduit adjacent the producing formation.

A pump means is then lowered on a second conduit, i.e. a production tubing string, into the well and through the corrosion inhibitor liquid to a point adjacent or slightly above the producing formation. The pump means is preferably an electrically driven, submergible, multistage centrifugal pump system wherein the electrical power cable is run into the well with the pump means. An annulus is formed in the well between the first and second conduits.

A packer means, e.g. a hydraulically actuated well packer, is mounted on the second conduit just above the pump means so that when the pump means is lowered into position in the well, the packer on the second conduit will lie adjacent or slightly above the producing formation. The power cable passes through the packer means in a fluid tight relationship therewith. The packer is set to isolate the pump means from the well annulus above the packer means. The pump means is then actuated to pump the corrosion inhibitor liquid from below the packer to the surface through the second conduit. Now the well is completed and ready to produce carbon dioxide. Carbon dioxide flows from the formation into the first conduit where the pump means compresses the carbon dioxide to a pressure sufficient to insure that the carbon dioxide will be produced at the surface through the second conduit at a pressure above the critical pressure of the produced carbon dioxide.

The corrosion inhibitor liquid above the packer means remains in that portion of the well annulus and serves to protect the inner surface of the first conduit and the external surface of the second conduit from the corrosive effects of any carbon dioxide that may leak or permeate through the packer means. This substantially extends the service life of both the first conduit and the second conduit which, in turn, can be a crucial consideration in the overall economics of the production operation.

In accordance with another aspect of the present invention there is provided a method for producing carbon dioxide from a carbon dioxide production well having a pump means suspended on a production tubing in said well to boost the pressure of the produced carbon dioxide to a value sufficient to produce carbon dioxide at the surface above its critical pressure. This aspect comprises setting a packer means just above said pump means to isolate said pump means from the annulus formed between the wellbore and said production tubing above said packer means; and filling said annulus above said packer means with a corrosion inhibitor liquid.

BRIEF DESCRIPTION OF THE DRAWINGS

The actual construction, operation, and apparent advantages of the present invention will be better understood by referring to the drawings in which like numerals identify like parts and in which.

DESCRIPTION OF THE PREFERRED EMBODIMENT

Formations capable of producing carbon dioxide in the qualities and quantities necessary for use in enhanced oil recovery operations normally have pore pressures sufficient to cause the carbon dioxide to flow to the surface without requiring the use of any artificial lift means, such as a downhole pump. However, the carbon dioxide expands as it flows upward in a well, thereby reducing the pressure of the carbon dioxide so that it normally arrives at the wellhead at a pressure at which the carbon dioxide exists as a two-phase fluid which, in turn, presents problems in gathering and pipelining the produced carbon dioxide. In copending U.S. patent application Ser. No. 38,034, filed May 10, 1979, a method is disclosed that overcomes these problems by producing the carbon dioxide at the surface in a single, supercritical stage. This is accomplished by lowering a pump means into the wellbore and compressing the carbon dioxide downhole to a pressure sufficient to insure that the carbon dioxide will arrive at the surface above its critical pressure.

Even though the bulk of the carbon dioxide is picked up by the pump means and produced to the surface through a production tubing string connected to the outlet of the pump means, some of the carbon dioxide inherently rises around the pump means and into the well annulus formed between the well casing and the tubing string.

As this carbon dioxide rises in the annulus and it expands due to a reduction in temperature and pressure, water vapor normally carried by the carbon dioxide condenses onto the interior surface of the steel casing and onto the exterior surface of the tubing. This water in conjunction with the carbon dioxide forms carbonic acid which is highly corrosive on both the steel casing and the steel tubing. It can be seen that as the casing and/or tubing becomes severely corroded, they will have to be replaced which, obviously, is extremely expensive in both down production time and in money. In accordance with the present invention, a carbon dioxide well is completed in a manner which alleviates these corrosive effects of the carbon dioxide on both the casing and the tubing.

Figure 1:
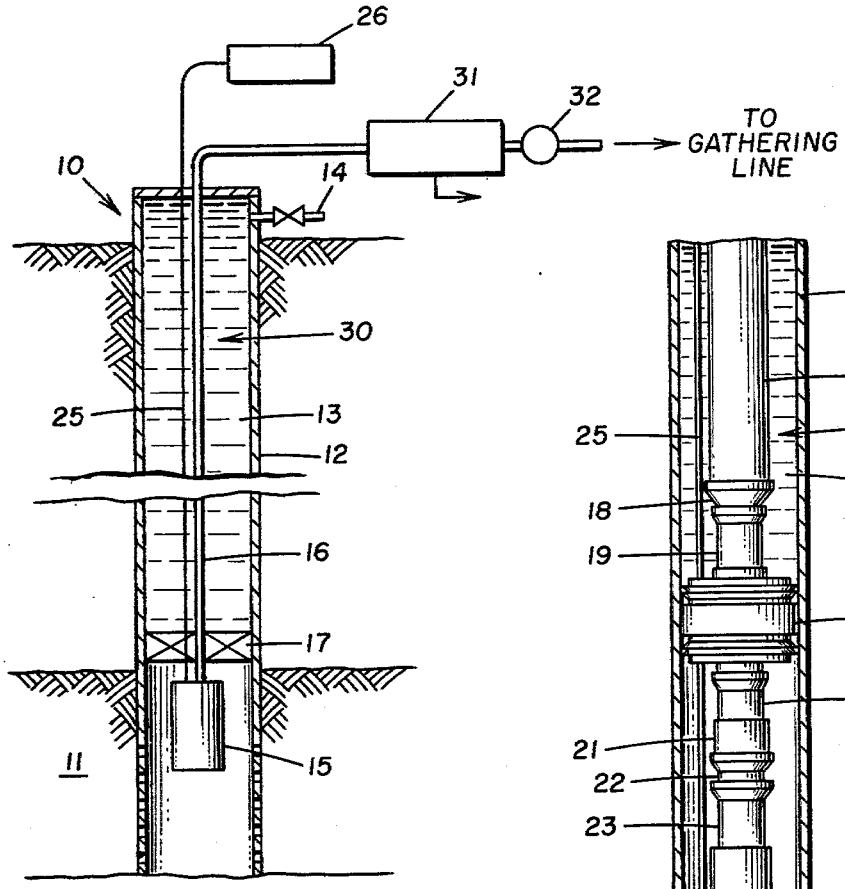
FIG. 1 is a sectional view of a carbon dioxide production well embodying the present invention.

Referring more particularly to the drawings, FIG. 1 discloses a well 10 which has been drilled into a carbon dioxide producing formation 11. Well 10 is cased with a first conduit, i.e. steel casing 12, as is well known in the art. Casing 12 is then filled with a corrosion inhibitor liquid 13 through inlet 14. Liquid 13 may be any liquid capable of inhibiting the corrosive effects of carbonic acid upon steel, for example, water containing a small amount (e.g. one percent) of a solution of a cationic, filming, amine corrosion inhibitor, one such inhibitor being commercially available as Cortron 2207, Champion Chemicals, Inc., Houston, Texas.

After casing 12 is filled with liquid 13, a perforating means (not shown) is lowered into well 10 and casing 12 is perforated adjacent formation 11 to establish fluid communication between formation 11 and the interior of casing 12 as is well known in the art. The hydraulic head of liquid 13 effectively "kills" the well during this time so carbon dioxide will not flow into casing 12 even after casing 12 has been perforated.

Figure 2:
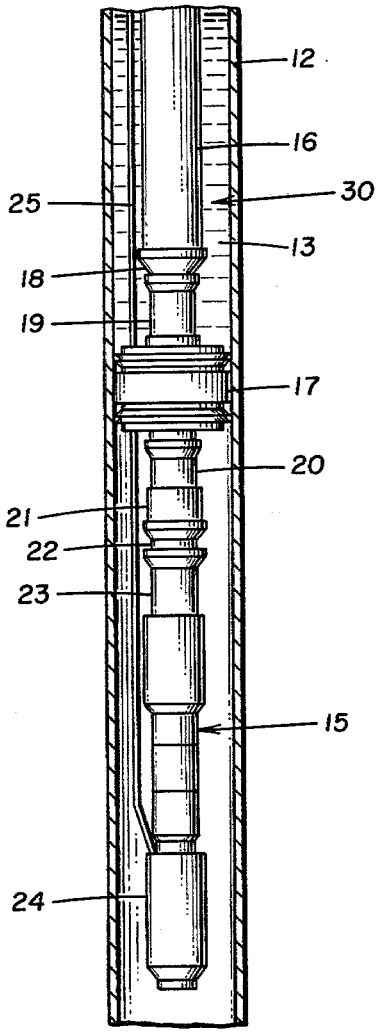
FIG. 2 is an enlarged, elevational view, partly in section, of the lower end of the well of FIG. 1.

Pump means 15 and packer means 17 are then lowered on a second conduit, e.g. steel production tubing string 16 into well 10. Referring now to FIG. 2 a typical arrangement is illustrated which may be used to assemble packer means 17 and pump means 15 onto the lower end of tubing 16. The lower end of tubing 16 has tubing adaptor 18 thereon which mates with pup joint 19 which in turn is affixed to the upper end of a fluid passage through packer means 17. While packer means 17 may be any of several available, commercially available well packers, preferably it is a retrievable, hydraulically-set packer such as a "RDH" Retrievable Hydraulic-Set Casing Packer, commerically available from Otis Engineering Corp., Dallas, Texas.

Pup joint 20 is affixed to the lower end of the fluid passage through packer 17 and is connected to tubing adaptor 22 by means of landing nipple 21. Adaptor 22 is coupled to pup joint 23 which, in turn, is connected to pump means 15 which is preferably a submergible, multistage centrifugal pump driven by electrical motor 24, such pump systems being commerically available from TRW Reda, a Division of TRW, Inc., Bartlesville, Oklahoma. Motor 24 is powered through power cable 25 which is run into well 10 with pump means 15 and is connected at its upper end to control means 26 at the surface. Cable 25 passes through a fluid tight, electrical feed-through connector in packer 17 as is known in the art.

Pump means and packer means 17 are lowered on tubing 16 through corrosion inhibitor liquid 13 to a point adjacent or slightly above formation 11. Packer means 17 is set, as understood in the art, to isolate pump means 15 from the annulus 30 above packer 17 which is formed between casing 12 and tubing 16. Pump means 15 is then actuated and the corrosion inhibitor liquid below packer 17 is pumped up tubing 16 and discarded. As the liquid is removed, carbon dioxide from formation 11 will flow into casing 12 below packer 17 where pump means 15 will boost its pressure to that sufficient to insure that the pressure of the carbon dioxide produced at the surface will be above its critical pressure. The produced supercritical carbon dioxide is flowed through separator 31 to remove any liquid water that may be present and through means 32 for measuring the amount of produced carbon dioxide, e.g. orifice meter, before it is delivered to a gathering line (not shown).

The corrosion inhibitor liquid 13 above packer 17 remains in annulus 30 during the production of carbon dioxide from formation 11. Any carbon dioxide that may leak pass or permeate through packer 17 is absorbed in liquid 13 thereby substantially alleviating the corrosive effects of the carbon dioxide on both casing 12 and tubing 16 and extending the service lives thereof.

Preferably, the interior of tubing 16 is coated with a corrosive resistive material, e.g. baked-on phenolic coatings, as is known in the art, and special corrosive resistant metals are used for pump parts and conduit sections below packer 17. This protects those portions of the downhole production system below packer 17 which is not protected by corrosion inhibitor liquid 13. It is noted that there is no harm done if casing 12 below packer 17 corrodes since fluid communication with formation 11 is desirable and already established by the perforations.

What is claimed is:

1. A method of completing a well for producing carbon dioxide from a subterranean formation comprising:

drilling a well into said formation;

casing said well with a first conduit;

filling said first conduit with a corrosion inhibitor liquid;

establishing fluid communication between said formation and the interior of said first conduit;

lowering a pump means on a second conduit into first conduit to a point adjacent or slightly above said formation, said first and second conduits forming an annulus therebetween;

isolating said pump means from said annulus above said pump means; and pumping out said corrosion inhibitor liquid from the isolated portion of said well surrounding said pump means through said second conduit while leaving said corrosion inhibitor liquid in said annulus above said isolated portion of said well.

2. The method of claim 1 wherein said pump means comprises:

an electrically driven, submergible, multistage centrifugal pump system.

3. The method of claim 2 wherein said step of isolating said pump means comprises:

setting a packer means around said pump means at a point slightly above said pump means.

4. The method of claim 3 wherein said packer means is affixed to and lowered with said second conduit.

5. The method of claim 4 wherein said corrosion inhibitor liquid comprises:

water containing a cationic, film forming, amine corrosion inhibitor compound.

6. In a method for producing carbon dioxide from a carbon dioxide production well having a pump means suspended on a production tubing in said well to boost the pressure of the produced carbon dioxide to a value sufficient to produce carbon dioxide at the surface above its critical pressure, the improvement comprising:

setting a packer means just above said pump means to isolate said pump means from the annulus formed between the wellbore and said production tubing above said packer means; and filling said annulus above said packer means with a corrosion inhibitor liquid.

* * * * *